US005379097A

United States Patent [19]

Aoto et al.

[11] Patent Number: 5,379,097

[45] Date of Patent: Jan. 3, 1995

[54] DEVELOPMENT APPARATUS FOR DEVELOPING LATENT ELECTROSTATIC IMAGES

[75] Inventors: Jun Aoto; Yasuo Hirano, both of Numazu, Japan

[73] Assignee: Ricoh Company, Ltd., Tokyo, Japan

[21] Appl. No.: 29,475

[22] Filed: Mar. 11, 1993

[30] Foreign Application Priority Data

Mar. 13, 1992 [JP] Japan ..... 4-089375

[51] Int. Cl.[6] ..... G03G 15/08

[52] U.S. Cl. ..... 355/259; 355/245

[58] Field of Search ..... 355/245, 259; 118/653, 118/661

[56] References Cited

U.S. PATENT DOCUMENTS 4,760,422 7/1988 Seimiya et al. ..... 355/259
4,908,665 3/1990 Takeda et al. ..... 355/259 X
5,142,330 8/1992 Hirano et al. ..... 355/259
5,168,312 12/1992 Aoto et al. ..... 355/259

*Primary Examiner*—Fred L. Braun
*Attorney, Agent, or Firm*—Cooper & Dunham

[57] ABSTRACT

A development apparatus including a developer-bearing-member for developing latent electrostatic images formed on a latent-electrostatic-image-bearing member to visible toner images by the application thereto of a non-magnetic one-component developer including matrix toner particles and a fluidity-imparting agent; and a developer-thin-layer-regulating member for forming a thin layer of the non-magnetic one-component developer on the surface of the developer-bearing member, the developer-bearing member having a surface portion which is intermediate between the matrix toner particles and the fluidity-imparting agent in the triboelectric series thereof.

8 Claims, 6 Drawing Sheets

Charge quantity of toner (μC/g)
-12
-8
-4
0
Ex. 7
Comp. Ex. 7
0
20
40
60
80
100
Specific inductive capacity ξr Toner deposition amount (mg/cm²)
1.2
0.8
0.4
0
Ex. 7
Comp. Ex. 7
0
20
40
60
80
100
Specific inductive capacity ξr Charge quantity of toner (μC/g)
+12
+8
+4
0
Ex. 8
Comp. Ex. 8
0
20
40
60
80
100
Specific inductive capacity ξr Toner deposition amount (mg/cm²)
1.2
0.8
0.4
0
Ex. 8
Comp. Ex. 8
0
20
40
60
80
100
Specific inductive capacity ξr

DEVELOPMENT APPARATUS FOR DEVELOPING LATENT ELECTROSTATIC IMAGES

BACKGROUND OF THE INVENTION

1. Field of the Invention

The present invention relates to a development apparatus in which a development process is carried out in such a manner that a non-magnetic one-component type developer comprising matrix toner particles and an auxiliary component is supplied to a developer-bearing-member which is driven in rotation, the developer on the developer-bearing-member is transported to a development area where the development-bearing-member and a latent-electrostatic-image-bearing member face each other, and the latent electrostatic images formed on the latent-electrostatic-image-bearing member are developed to visible toner images by the above-mentioned developer.

2. Discussion of the Background

An image forming machine such as an electrophotographic copier, printer or facsimile machine commonly employs a dry-type development apparatus in which latent electrostatic images formed on a latent-electrostatic-image-bearing member are developed to visible toner images by use of a dry-type developer to obtain recorded images.

The conventional dry-type developer is divided into two groups; a two-component developer comprising a toner and a carrier, and a one-component developer comprising a toner. Although the two-component developer can produce relatively stable recorded images, it has the shortcoming that the carrier component easily deteriorates, causing the mixing ratio of the toner component to the carrier component to easily vary. Therefore, maintenance and control of the development apparatus employing the two-component developer become complicated, and consequently, it is difficult to make the development apparatus compact in size.

With these shortcomings of the two-component developer taken into consideration, attention has been paid to the one-component developer. Two kinds of one-component developers are conventionally known, one comprises toner particles, and the other comprises toner particles and an auxiliary component. The auxiliary component is, for example, a fluidity-imparting agent capable of improving the fluidity of the toner particles.

In a development apparatus employing the one-component developer, the one-component developer supplied to a developer-bearing-member is transported to a development area where the developer-bearing-member and a latent-electrostatic-image-bearing member face each other, and the latent electrostatic images formed on the latent-electrostatic-image-bearing member are developed to visible toner images by the one-component developer. To form high-quality toner images with a predetermined image density on the latent-electrostatic-image-bearing member, it is necessary to transport a large quantity of the toner which is sufficiently charged to a preset polarity to the development area.

The optimal deposition amount and charge quantity of a non-magnetic one-component type developer will now be explained in detail.

In the formation of black and white images, the charge quantity of toner, to which great importance is attached, is generally in the range from 5 to 20 $\mu C/g$. When the charge quantity of the toner is less than the above-mentioned range, the obtained image quality becomes poor because of toner deposition on the background and insufficient sharpness of the obtained images. The deposition amount of the toner on the developer-bearing member such as a development roller is generally in the range of 0.1 to 0.3 $mg/cm^2$. On the other hand, the required deposition amount of toner on a sheet of image-receiving paper is 0.8 to 1.0 $mg/cm^2$. To satisfy the above-mentioned toner deposition amount on the image-receiving sheet, the rotational speed of the development roller is set three to four times that of the latent-electrostatic-image-bearing member such as a photoconductor. When the development roller is rotated as fast as previously mentioned, however, only the end portion of a solid black image shows an increased image density. The above phenomenon can be eliminated by approximating the rotational speed of the development roller to that of the photoconductor. Consequently, it is desirable to decrease the rotational speed of the development roller, and at the same time, to increase the toner deposition amount on the development roller.

When the one-component developer comprising the matrix toner particles and the fluidity-imparting agent is used in the development apparatus, the above-mentioned desired charge quantity and deposition amount of the toner on the development roller cannot be obtained because the triboelectric charging of the toner cannot be increased. There is an increasing demand for a development apparatus in which an appropriate charge quantity of the toner and a proper toner deposition amount on the development roller can be obtained even though the one-component type developer comprising the matrix toner particles and the fluidity-imparting agent is used therein.

SUMMARY OF THE INVENTION

Accordingly, an object of the present invention is to provide a development apparatus for developing latent electrostatic images, capable of giving an appropriate charge quantity to the employed toner and ensuring a sufficient toner deposition amount on a development roller even though the one-component developer comprising the matrix toner particles and the fluidity-imparting agent is used therein.

The above-mentioned object of the present invention can be achieved by a development apparatus comprising a developer-bearing-member for developing latent electrostatic images formed on a latent-electrostatic-image-bearing member to visible toner images by the application thereto of a non-magnetic one-component developer comprising matrix toner particles and a fluidity-imparting agent, and a developer-thin-layer-regulating member for forming a thin layer of the non-magnetic one-component developer on the surface of the developer-bearing member, the developer-bearing member having a surface portion which is intermediate between the matrix toner particles and the fluidity-imparting agent in the triboelectric series thereof.

BRIEF DESCRIPTION OF THE DRAWINGS

A more complete appreciation of the invention and many of the attendant advantages thereof will be readily obtained as the same becomes better understood by reference to the following detailed description when considered in connection with the accompanying drawings, wherein.

DESCRIPTION OF THE PREFERRED EMBODIMENTS

The development apparatus of the present invention employs a non-magnetic one-component developer comprising matrix toner particles and a fluidity-imparting agent. In this case, since the surface portion of a developer-bearing member is intermediate between the matrix toner particles and the fluidity-imparting agent in the triboelectric series thereof, the proper charge quantity of toner and toner deposition amount on the developer-bearing member can be obtained even when the employed developer comprises matrix toner particles and the fluidity-imparting agent.

The mechanism of a development apparatus according to the present invention will now be described in detail with reference to FIGS. 1 and 2.

Figure 1:
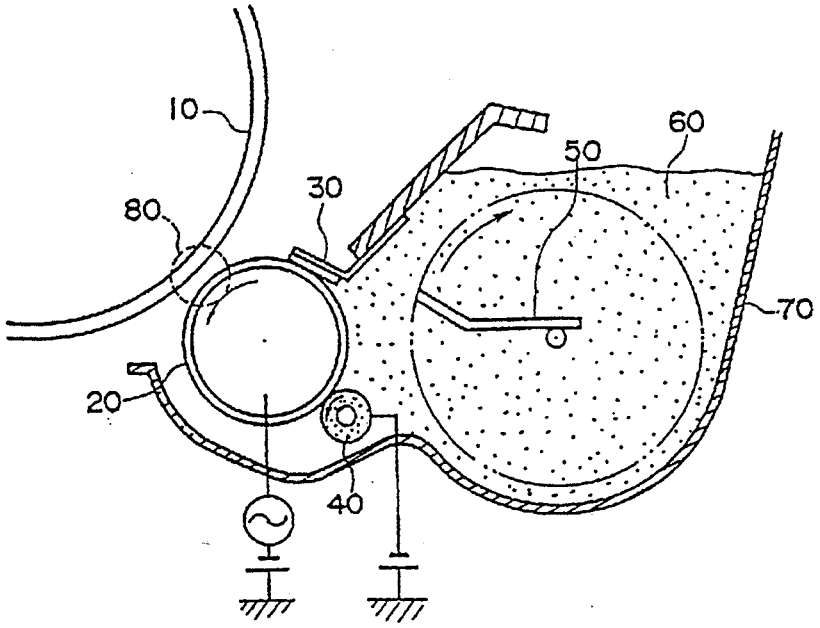
FIG. 1 is a schematic cross-sectional view of one embodiment of a development apparatus according to the present invention.

In FIG. 1, a non-magnetic one-component developer (toner) 60 contained in a developer tank 70 is forcibly sent to a developer-supplying member (sponge roller) 40 by means of a developer-supplying auxiliary member (stirring blade) 50, so that the developer-supplying member 40 is supplied with the developer 60.

A portion of a developer-bearing roller (development roller) 20 which is directed toward the surface of a latent-electrostatic-image-bearing member 10, has completed the development of latent electrostatic images at a development area 80, and comes to a contact area with the developer-supplying member 40 as it is rotated in the direction of the arrow. The developer-supplying member 40 is rotated in a direction opposite to that of the developer-bearing member 20 at the contact point thereof. The developer-bearing member 20 and the developer 60 are therefore electrically charged, causing the developer 60 to deposit on the surface of the developer-bearing member 20. The developer 60 deposited on the surface of the developer-bearing member 20 is regulated by a developer-thin-layer-regulating member (elastic blade) 30 while the developer-bearing member 20 is rotated, so that a uniform thin layer of the developer 60 is formed on the developer-bearing member 20, and at the same time, the electric charge of the developer 60 is stabilized.

When the developer 60 deposited on the developer-bearing member 20 arrives at the development area 80, the latent electrostatic images formed on the latent-electrostatic-image-bearing member 10 are developed into visible toner images by the developer 60 in accordance with the contact or non-contact development method. To obtain an optimal toner image, a bias such as a direct current, alternating current, direct-current-superposed alternating current or pulse may be applied to the developer-bearing member 20 and the developer-supplying member 40 when necessary.

In the development apparatus which employs a one-component developer comprising matrix toner particles and a fluidity-imparting agent, it is confirmed that the triboelectric series among the surface portion of the developer-bearing member, the matrix toner particles and the fluidity-imparting agent has a serious effect on the triboelectric charging of the toner. When the surface portion of the developer-bearing member is intermediate between the matrix toner particles and the fluidity-imparting agent in the triboelectric series thereof, the triboelectric charging is dominantly carried out between the matrix toner particles and the fluidity-imparting agent. In this case, the surface portion of the developer-bearing member scarcely participates in the triboelectric charging. The matrix toner particles are repeatedly brought into contact with the fluidity-imparting agent, thereby increasing the charge quantity of the matrix toner particles. Owing to the electrostatic field thus obtained, the toner is deposited on the surface of the developer-bearing member.

To obtain a desired charge quantity of toner, it is preferable that the matrix toner particles and the fluidity-imparting agent be arranged apart from each other in the triboelectric series thereof.

The toner for use in the present invention is deposited on the developer-bearing member by means of the electrostatic field induced by the toner itself. The deposition force F of the toner onto the developer-bearing member is expressed by the following formulas:

[In the case where the surface portion of the developer-bearing member is electroconductive];

$$F=q^2/(4\pi\epsilon_0 r^2) \quad (1)$$

[In the case where the surface portion of the developer-bearing member is electrically insulating];

$$F=[(\epsilon_r-1)/(\epsilon_r+1)]\times q^2/(4\pi\epsilon_0 r^2) \quad (2)$$

wherein $\epsilon_r$ represents a specific inductive capacity, $\epsilon_0$ represents a dielectric constant in vacuo, q represents a charge quantity of toner and r represents a distance between the toner and the developer-bearing member to be employed.

As can be seen from the above formulas, when the surface portion of the developer-bearing member is electroconductive, the deposition force F of the charged toner onto the developer-bearing member is larger due to the image force in accordance with the formula (1), as compared with the case where the deposition force F of the toner is obtained in accordance with the formula (2) when the surface portion of the developer-bearing member is electrically insulating. It is supposed that a large quantity of the toner can be deposited on the developer-bearing member when the surface portion of the developer-bearing member is electroconductive. Therefore, the volume resistivity of the surface portion of the developer-bearing member is preferably less than $10^{12}$ Ω·cm.

From the viewpoints of the leak of the electric charge to the photoconductor and the gradation of the obtained images, however, it is desirable to impart the electrically insulating properties to the surface portion of the developer-bearing member to some extent. When the electrically insulating material is used for the surface portion of the developer-bearing member, as can be seen from the formulas (1) and (2), the deposition force F of the toner onto the developer-bearing member is smaller, as compared with the case where the surface portion of the developer-bearing member is electroconductive, as previously explained. As a result., the amount of the toner deposited on the developer-bearing member is not always sufficient for practical use. However, it is confirmed that a sufficient amount of toner can be deposited on the developer-bearing member when the surface portion of the developer-bearing member is extremely thin even though the surface portion is electrically insulating. More specifically, when the desired amount of toner is deposited on the developer-bearing member, the thickness of the toner layer formed on the developer-bearing member is about 30 to 50 μm. In the case where the thickness of the surface portion of the developer-bearing member is sufficiently thicker than the above-mentioned toner layer, the deposition force F of the toner onto the developer-bearing member is determined in accordance with the formula (2). In contrast to this, when the thickness of the surface portion of the developer-bearing member is sufficiently thinner than the above-mentioned toner layer, the toner layer formed on the developer-bearing member is influenced by the image force induced by an electrode located on the rear side of the electrically insulating surface portion of the developer-bearing member, so that a large amount of toner can be deposited on the developer-bearing member. In the present invention, therefore, it is preferable that the volume resistivity of the surface portion of the developer-bearing member be $10^{12}$ Ω·cm or more and the thickness of the surface portion be 10 μm or less when the surface portion of the developer-bearing member is electrically insulating.

Furthermore, it is confirmed that a sufficient amount of toner can be deposited on the developer-bearing member when the specific inductive capacity of the surface portion of the developer-bearing member is 20 or more even if it is electrically insulating. This is because the deposition force F of the toner onto the developer-bearing member in accordance with the aforementioned formula (2) attains to 90% or more of the deposition force (F) obtained in accordance with the formula (1) when the specific inductive capacity of the surface portion is 20 or more. Therefore, it is preferable that the specific inductive capacity of the surface portion of the developer-bearing member be 20 or more when it is electrically insulating.

In the triboelectric series among the surface portion of the developer-bearing member, the matrix toner particles and the fluidity-imparting agent, it is preferable to consider the position of the surface portion of the developer-thin-layer-regulating member for use in the development apparatus of the present invention. To obtain a sufficient charge quantity of toner and deposition amount of toner on the developer-bearing member, in the present invention, it is preferable that both of the surface portion of the developer-bearing member and the surface portion of the developer-thin-layer-regulating member be intermediate between the matrix toner particles and the fluidity-imparting agent in the triboelectric series thereof. With the relation of the above-mentioned four components in the triboelectric series thereof being satisfied, the matrix toner particles and the fluidity-imparting agent dominantly participate in the triboelectric charging of toner, while the surface portion of the developer-bearing member and the surface portion of the developer-thin-layer-regulating member do not substantially contribute to the triboelectric charging of toner. In this case, it is also preferable that the volume resistivity of the surface portion of the developer-bearing member be less than $10^{12}$ Ω·cm for the same reason as previously described.

Furthermore, when both the surface portion of the developer-bearing member and the surface portion of the developer-thin-layer-regulating member have a volume resistivity of less than $10^{12}$ Ω·cm, the toner can effectively be deposited on the developer-bearing member by applying an electric field across the above-mentioned two members. In this case, the bias is applied in the predetermined direction depending upon the type of toner as shown in Table 1.

TABLE 1

| Type of Toner | Direction of Applied Bias |
|---|---|
| positively-chargeable toner | from developer-thin-layer-regulating member to developer-bearing member |
| negatively-chargeable toner | from developer-bearing member to developer-thin-layer-regulating member |

By the injection of the electric charge as shown in Table 1, the charge quantity of toner can be further increased, and at the same time, toner particles oppositely charged to the predetermined polarity can be prevented from appearing on the development area, thereby avoiding the toner deposition on the background.

To prepare the matrix toner particles for use in the present invention, a coloring agent, a charge controlling agent and a releasing agent are added to a binder resin when necessary and the mixture thus obtained is kneaded, pulverized and classified until the particle diameter of the matrix toner particles is about 10 μm. Examples of the binder resin for use in the matrix toner particles are styrene-acryl copolymer, polyester, epoxy resin, and ethylene-vinyl acetate copolymer. The one-component developer for use in the present invention comprises the fluidity-imparting agent for the purpose of improving the fluidity of the developer. Specific examples of the fluidity-imparting agent for use in the present invention are silica, a metallic soap, a nonionic surface active agent and finely-divided particles of polyvinylidene fluoride.

For the surface portion of the developer-bearing member and the developer-thin-layer-regulating member in the development apparatus of the present invention, conventionally employed resins and rubbers are usable. Specific examples of the material for the surface portion of the developer-bearing member and the developer-thin-layer-regulating member are as follows: vinyl resins such as polyvinyl chloride, polyvinyl butyral, polyvinyl alcohol, polyvinylidene chloride, polyvinyl acetate and polyvinylformal; styrene-based resins such as polystyrene, styrene-acrylonitrile copolymer and acrylonitrile-butadiene-styrene copolymer; ethylene-based resins such as polyethylene and ethylene-vinyl acetate copolymer; acrylic resins such as polymethyl methacrylate and polymethyl methacrylate-styrene copolymer; other resins such as polyacetal, polyamide, cellulose, polycarbonate, phenoxy resin, polyester, fluoroplastic, polyurethane, phenolic resin, urea resin, melamine resin, epoxy resin, unsaturated polyester resin and silicone resin; and rubbers such as a natural rubber, isoprene rubber, butadiene rubber, styrene-butadiene rubber, butyl rubber, ethylene-propylene rubber, chloroprene rubber, chlorinated polyethylene rubber, epichlorohydrin rubber, nitrile rubber, acrylic rubber, urethane rubber, polysulfide rubber, silicone rubber, fluororubber and silicone-modified ethylene-propylene rubber.

When the surface portion of the developer-bearing member with a volume resistivity of less than $10^{12}$ Ω·cm is used in the present invention, a resin or rubber with such a volume resistivity may be selected from the above-mentioned materials. Alternatively, the volume resistivity can be controlled by the addition of carbon black, or finely-divided particles of a metal or metallic oxide.

When the surface portion of the developer-bearing member with a volume resistivity of $10^{12}$ Ω·cm or more is used, a resin or rubber with such a volume resistivity may be selected from the above-mentioned materials.

In addition, when the surface portion of the developer-bearing member with a specific inductive capacity of 20 or more is used, a material having a large specific inductive capacity may be added to the above-mentioned conventional resins and rubbers.

Specific examples of the material having a large specific inductive capacity include organic polymers such as polyvinyl fluoride, polyvinylidene fluoride, polyamide, polyurethane, nitrile-butadiene rubber, hydrin rubber and fluorosilicone rubber; ferroelectric substances such as barium titanate, strontium titanate, salts of titanic acid, rochelle salt and potassium dihydrogenphosphate; ceramics such as alumina, beryllia, magnesia, silicon nitride, mullite, stearite, forsterite and zircon; and metallic oxides such as titanium oxide, magnesium oxide and zinc oxide. These materials can be used alone or in combination.

Of the above-mentioned resins and rubbers, the fluorine-containing resin and rubber or silicone resin and rubber are preferable from the viewpoints of the environmental resistance and the releasability. Further, the silicone resins and rubbers are more preferable in terms of the cost and the dispersion properties of the above-mentioned additive capable of controlling the volume resistivity.

To prepare the surface portion of the developer-bearing member or the developer-thin-layer-regulating member, a charge controlling agent such as nigrosine, quaternary ammonium salt, a metal-containing azo dye, a higher fatty acid metallic salt, or a phthalocyanine compound; and an inorganic filler such as silica, calcium carbonate, magnesium carbonate or barium sulfate may be added to the above-mentioned resins and rubbers when necessary. In this case, these additives are contained in the resins or rubbers, with the relation that the surface portion of the developer-bearing member, and preferably the surface portion of the developer-thin-layer-regulating member, are intermediate between the matrix toner particles and the fluidity-imparting agent in the triboelectric series thereof being satisfied.

The configuration of the developer-bearing member and the developer-thin-layer-regulating member is not limited as long as the surface portion of each member has the above-mentioned properties.

Other features of this invention will become apparent in the course of the following description of exemplary embodiments, which are given for illustration of the invention and are not intended to be limiting thereof.

Examples 1 to 4 and Comparative Examples 1 to 4

The following components were separately mixed and dispersed to prepare negatively-chargeable matrix toner particles (1) and positively-chargeable matrix toner particles (2):

| | Parts by Weight |
|---|---|
| [Negatively-chargeable matrix toner particles 1] | |
| Styrene-acryl copolymer | 95 |
| Low-molecular weight polypropylene | 5 |
| Carbon black | 8 |
| Zinc salt of salicylic acid derivative | 4 |
| [Positively-chargeable matrix toner particles 2] | |
| Styrene-acryl copolymer | 95 |
| Low-molecular weight polypropylene | 5 |
| Carbon black | 7 |
| Nigrosine dye | 3 |

The above prepared two kinds of matrix toner particles 1 and 2 were separately mixed with a fluidity-imparting agent A or B in a mixer in accordance with the predetermined combination shown in Table 2 in such a fashion that the fluidity-imparting agent was added in an amount of 0.5 wt. % of the total weight of the matrix toner particles. Thus, four kinds of non-magnetic one-component developers (Toners A, B, C and D) were prepared.

TABLE 2

| Example No. | Toner | Matrix Toner Particles | Fluidity-imparting Agent |
|---|---|---|---|
| Ex. 1 | Toner A | Negatively-chargeable toner particles 1 | A (note:*) |
| Ex. 2 | Toner B | Negatively-chargeable toner particles 1 | B (note:**) |
| Ex. 3 | Toner C | Positively-chargeable toner particles 2 | A (note:*) |

TABLE 2-continued

| Example No. | Toner | Matrix Toner Particles | Fluidity-imparting Agent |
|---|---|---|---|
| Ex. 4 | Toner D | Positively-chargeable toner particles 2 | B (note:**) |

Note:
(*): A commercially available silica "H2000" (Trademark), made by Hoechst Japan Limited.
(**): A commercially available silica "HVK21" (Trademark), made by Hoechst Japan Limited.

Two kinds of developer-bearing members were prepared by the following method:

[Developer-bearing member (I)]

The following components were mixed to prepare a coating liquid:

| | Parts by Weight |
|---|---|
| Silicone resin "SR2411" (Trademark), made by Dow Corning Toray Silicone Co., Ltd. | 100 |
| Carbon black "BP-L" (Trademark), made by Cabot Corporation | 5 |
| Toluene | 300 |

The above prepared coating liquid was coated on a core roll by spray coating and cured at 100° C. for one hour. Thus, a developer-bearing member (I) was prepared. The volume resistivity of the surface portion of the obtained developer-bearing member (I) was $2.5\times10^8$ Ω·cm.

[Developer-bearing member (II)]

A mixture of the following components was kneaded in a two-roll mill:

| | Parts by Weight |
|---|---|
| Methylvinyl polysiloxane | 100 |
| Carbon black "Ketjen black EC" (Trademark), made by Lion Akzo Co., Ltd. | 5 |
| Quarts | 20 |

1.5 parts by weight of a commercially available cross-linking agent (2,4-dimethyl-2,4-ditertiary-butyl peroxyhexane), "RX-4" (Trademark), made by Dow Corning Toray Silicone Co., Ltd., were added to 100 parts by weight of the above prepared mixture. The thus prepared product was vulcanized at 170° C. for 10 minutes with the application of a pressure of 120 kg/cm$^2$ thereto, and then press-molded at 200° C. for 4 hours. Thus, a developer-bearing member (II) was prepared. The volume resistivity of the surface portion of the obtained developer-bearing member (II) was $1.5\times10^5$ Ω·cm.

The thus prepared matrix toner particles 1 and 2, the fluidity-imparting agents A and B, and the developer-bearing members (I) and (II) were arranged in the following triboelectric series:

The development apparatus as shown in FIG. 1 was operated, with provided with any of the previously obtained toners and the developer-bearing member (I) or (II) in combination as shown in Table 3, and the charge quantity of the toner was measured by the blow-off method and the toner deposition amount was measured by transferring the toner attached to the surface of the developer-bearing member to an adhesive tape. The results are also given in Table 3.

TABLE 3

| | Developer-bearing Member | Toner | Charge Quantity of Toner (μC/g) | Toner Deposition Amount (mg/cm$^2$) |
|---|---|---|---|---|
| Ex. 1 | I | B | −6.5 | 1.10 |
| Ex. 2 | I | C | +7.9 | 1.23 |
| Comp. Ex. 1 | I | A | −2.0 | 0.41 |
| Comp. Ex. 2 | I | D | +1.2 | 0.50 |
| Ex. 3 | II | B | −8.2 | 1.20 |
| Ex. 4 | II | C | +9.3 | 1.31 |
| Comp. Ex. 3 | II | A | −1.5 | 0.42 |
| Comp. Ex. 4 | II | D | +1.2 | 0.55 |

As can be seen from the results in Table 3, sufficient charge quantity of toner and toner deposition amount can be obtained when the surface portion of the developer-bearing member is intermediate between the matrix toner particles and the fluidity-imparting agent in the triboelectric series thereof.

Examples 5 and 6 and Comparative Examples 5 and 6

A developer-bearing member III was prepared by the following method:

[Developer-bearing member (III)]

The following components were mixed to prepare a coating liquid:

| | Parts by Weight |
|---|---|
| Silicone resin "SR2411" (Trademark), made by Dow Corning Toray Silicone Co., Ltd. | 100 |
| Toluene | 300 |

The above prepared coating liquid was coated on a core roll by spray coating and cured at 100° C. for one hour. Five kinds of developer-bearing members with a thickness of 5, 10, 30, 60 and 150 μm were prepared by changing the coating amount of the above prepared coating liquid. The volume resistivity of the surface portion of the obtained developer-bearing member (III) was $2.5\times10^{13}$ Ω·cm.

The above prepared matrix toner particles 1 and 2, the fluidity-imparting agents A and B, and the developer-bearing member (III) were arranged in the following triboelectric series:

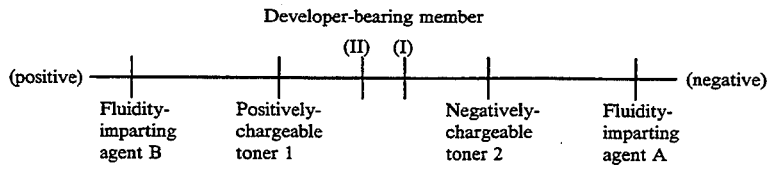

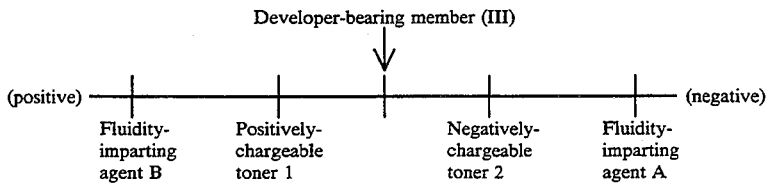

Figure 3:
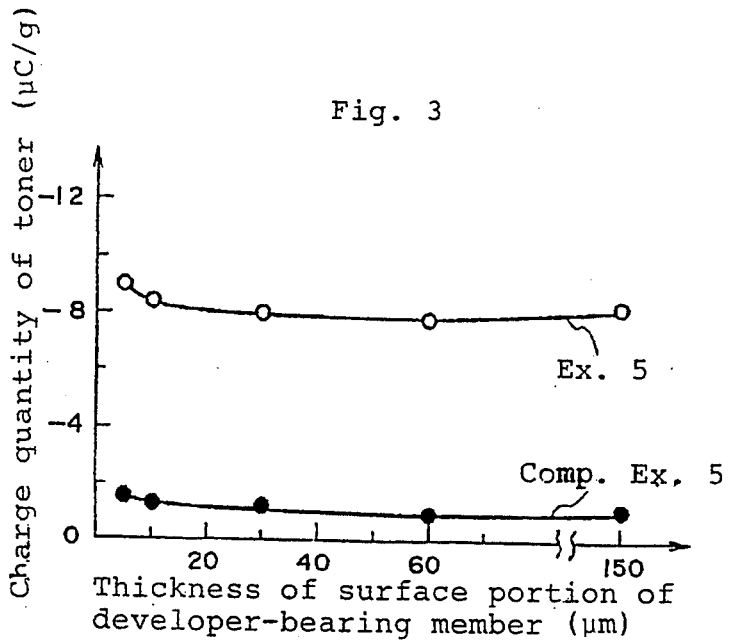
FIG. 3 is a graph showing the relationship between the thickness of the surface portion of a developer-bearing member and the charge quantity of toner in the development apparatuses obtained in Example 5 and Comparative Example 5.

The development apparatus as shown in FIG. 1 was operated, with provided with any of the previously obtained toners and the developer-bearing member (III) in combination as shown in Table 4, and the charge quantity of the toner and the toner deposition amount were measured by the same methods as in Example 1. The relationship between the charge quantity of toner and the thickness of the surface portion of the developer-bearing member (III), and the relationship between the toner deposition amount and the thickness of the surface portion of the developer-bearing member (III) obtained in Example 5 and Comparative Example 5 are respectively shown in FIGS. 3 and 4. The relationship between the charge quantity of toner and the thickness of the surface portion of the developer-bearing member (III), and the relationship between the toner deposition amount and the thickness of the surface portion of the developer-bearing member (III) obtained in Example 6 and Comparative Example 6 are respectively shown in FIGS. 5 and 6.

TABLE 4

| | Developer-bearing Member | Toner |
|---|---|---|
| Ex. 5 | III | B |
| Ex. 6 | III | C |
| Comp. Ex. 5 | III | A |
| Comp. Ex. 6 | III | D |

Figure 4:
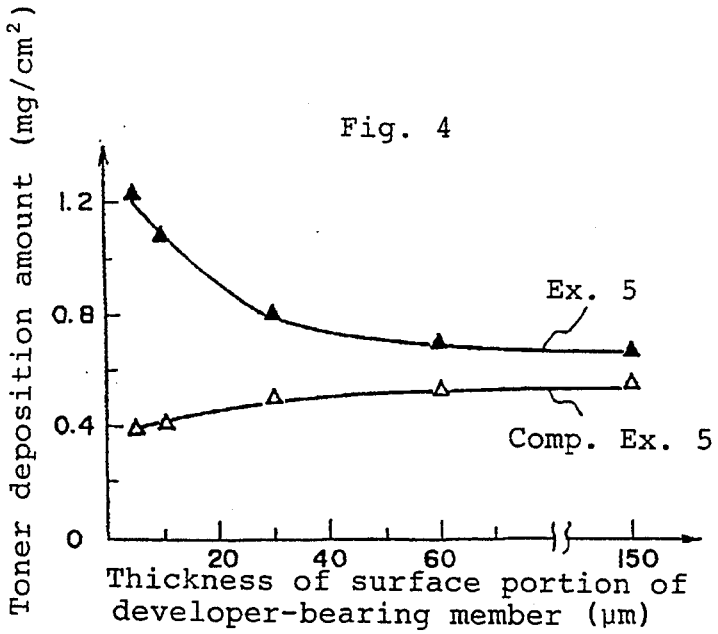
FIG. 4 is a graph showing the relationship between the thickness of the surface portion of a developer-bearing member and the toner deposition amount in the development apparatuses obtained in Example 5 and Comparative Example 5.
Figure 5:
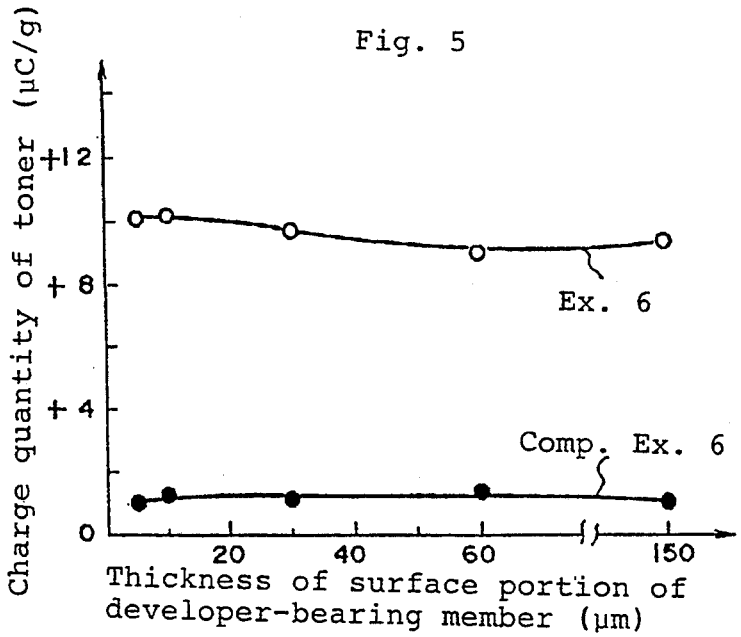
FIG. 5 is a graph showing the relationship between the thickness of the surface portion of a developer-bearing member and the charge quantity of toner in the development apparatuses obtained in Example 6 and Comparative Example 6.
Figure 6:
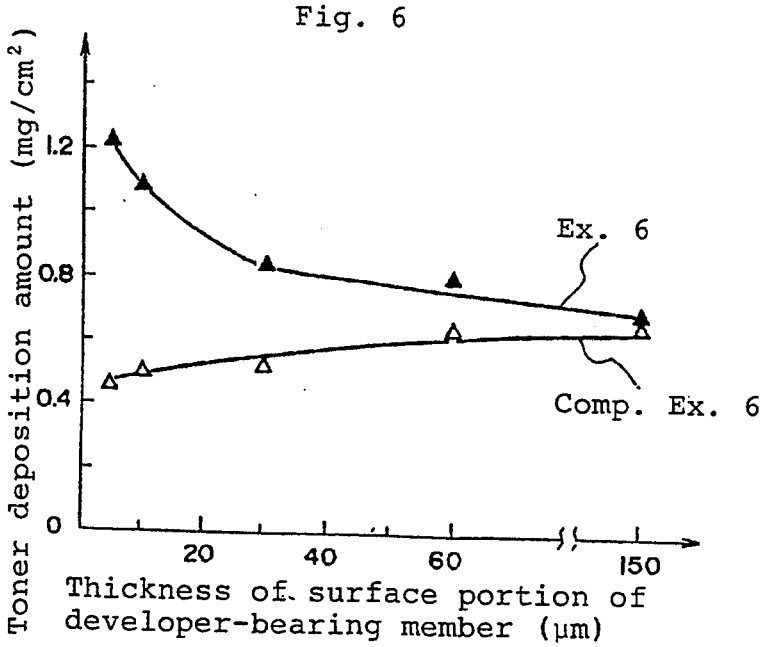
FIG. 6 is a graph showing the relationship between the thickness of the surface portion of a developer-bearing member and the toner deposition amount in the development apparatuses obtained in Example 6 and Comparative Example 6.

As is apparent from the graphs in FIGS. 4 and 6, when the surface portion of the developer-bearing member is intermediate between the matrix toner particles and the fluidity-imparting agent in the triboelectric series thereof, sufficient toner deposition amount on the developer-bearing member can be obtained in the case where the thickness of the surface portion of the developer-bearing member is 10 μm or less even though the surface portion of the developer-bearing member is electrically insulating with a volume resistivity of $10^{12}$ Ω·cm or more.

Examples 7 and 8 and Comparative Examples 7 and 8

A developer-bearing member (IV) was prepared by the following method:

A commercially available $PbTiO_3$-$PbZrO_3$, "PZT" (Trademark), made by Sumitomo Cement Co., Ltd., having a specific inductive capacity of as high as 1200 was added to a commercially available silicone resin "SR2411" (Trademark), made by Dow Corning Toray Silicone Co., Ltd. The mixture thus obtained was coated on a core roll by spray coating. Thus, a developer-bearing member (IV) was prepared. Five kinds of developer-bearing members with a specific inductive capacity of 5, 10, 20, 50 and 100 were prepared by changing the addition amount of the "PZT".

The above prepared matrix toner particles 1 and 2, the fluidity-imparting agents A and B, and the developer-bearing member (IV) were arranged in the following triboelectric series:

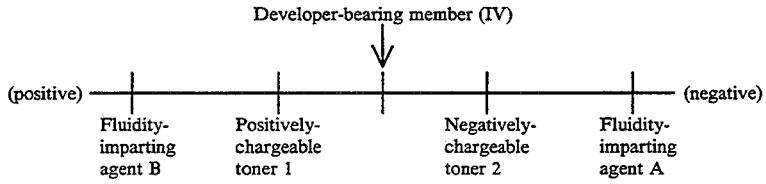

Figure 7:
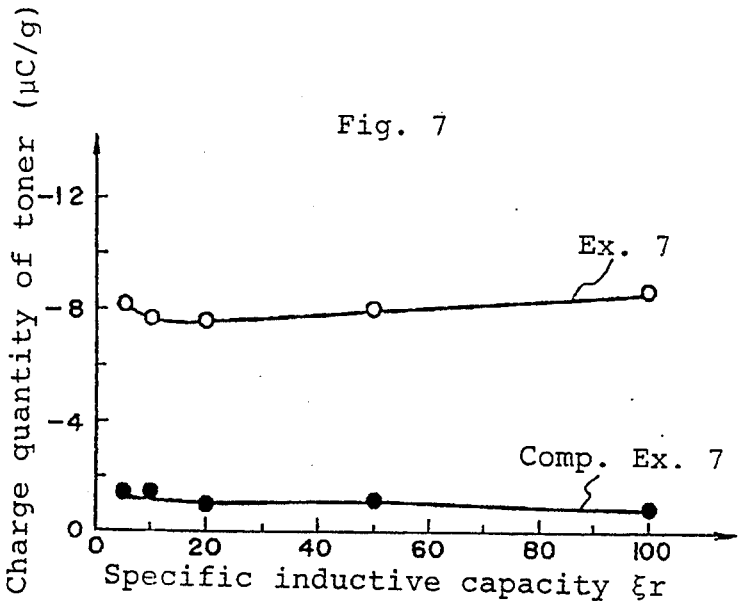
FIG. 7 is a graph showing the relationship between the specific inductive capacity of the surface portion of a developer-bearing member and the charge quantity of toner in the development apparatuses obtained in Example 7 and Comparative Example 7.

The development apparatus as shown in FIG. 1 was operated, with provided with any of the previously obtained toners and the developer-bearing member (IV) in combination as shown in Table 5, and the charge quantity of the toner and the toner deposition amount were measured by the same methods as in Example 1. The relationship between the charge quantity of toner and the specific inductive capacity of the surface portion of the developer-bearing member (IV), and the relationship between the toner deposition amount and the specific inductive capacity of the surface portion of the developer-bearing member (IV) obtained in Example 7 and Comparative Example 7 are respectively shown in FIGS. 7 and 8. The relationship between the charge quantity of toner and the specific inductive capacity of the surface portion of the developer-bearing member (IV), and the relationship between the toner deposition amount and the specific inductive capacity of the surface portion of the developer-bearing member (IV) obtained in Example 8 and Comparative Example 8 are respectively shown in FIGS. 9 and 10.

TABLE 5

| | Developer-bearing Member | Toner |
|---|---|---|
| Ex. 7 | IV | B |
| Ex. 8 | IV | C |
| Comp. Ex. 7 | IV | A |
| Comp. Ex. 8 | IV | D |

Figure 8:
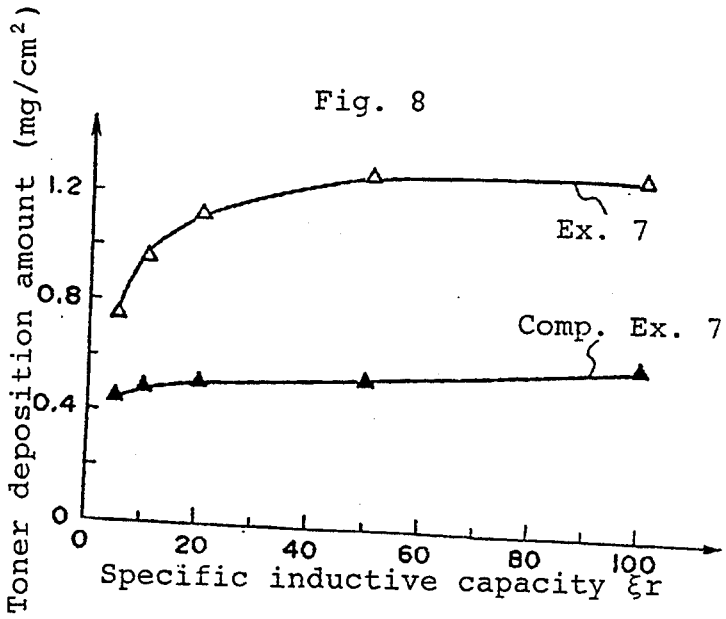
FIG. 8 is a graph showing the relationship between the specific inductive capacity of the surface portion of a developer-bearing member and the toner deposition amount in the development apparatuses obtained in Example 7 and Comparative Example 7.
Figure 9:
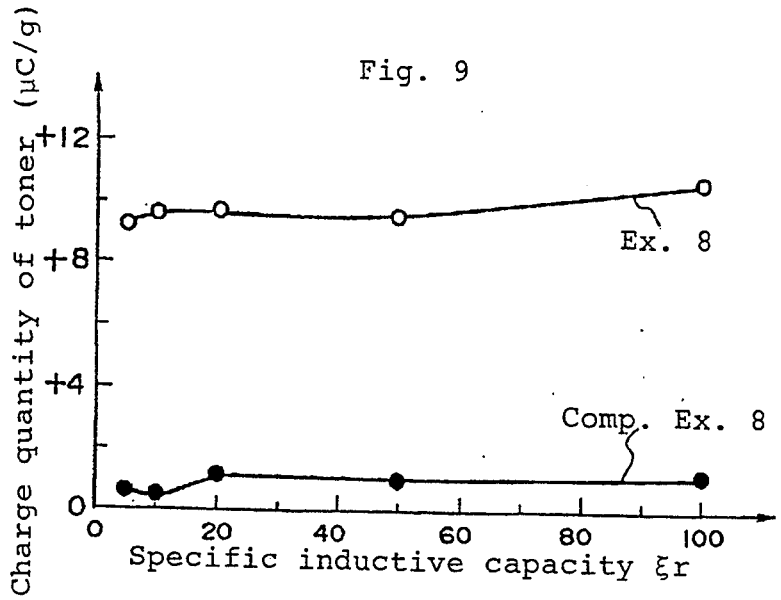
FIG. 9 is a graph showing the relationship between the specific inductive capacity of the surface portion of a developer-bearing member and the charge quantity of toner in the development apparatuses obtained in Example 8 and Comparative Example 8.
Figure 10:
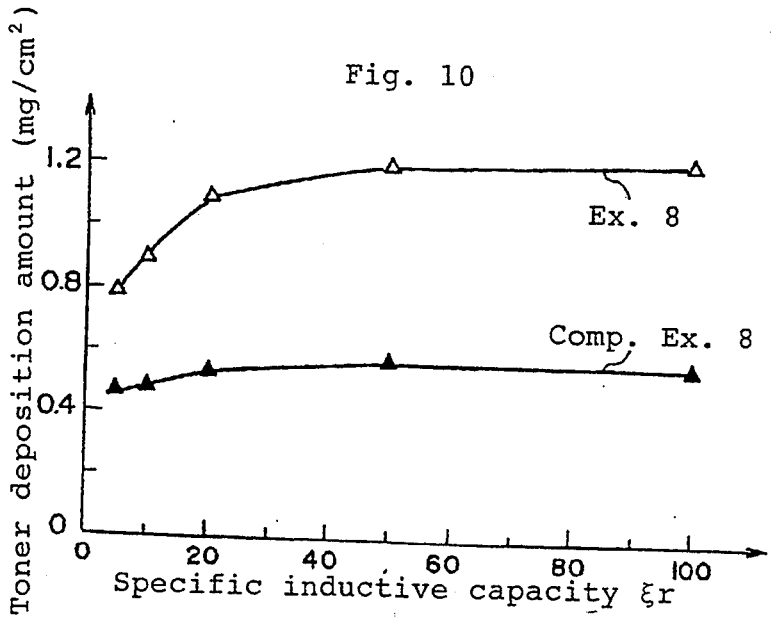
FIG. 10 is a graph showing the relationship between the specific inductive capacity of the surface portion of a developer-bearing member and the toner deposition amount in the development apparatuses obtained in Example 8 and Comparative Example 8.

As is apparent from the graphs in FIGS. 8 and 10, when the surface portion of the developer-bearing member is intermediate between the matrix toner particles and the fluidity-imparting agent in the triboelectric series thereof, sufficient toner deposition amount can be obtained in the case where the specific inductive capacity of the surface portion of the developer-bearing member is 20 or more even though the surface portion of the developer-bearing member is electrically insulating.

Examples 9 to 12 and Comparative Examples 9 to 12

Two kinds of developer-thin-layer-regulating members were prepared by the following method:

[Developer-thin-layer-regulating member (a)]

The following components were mixed to prepare a coating liquid:

| | Parts by Weight |
|---|---|
| Silicone resin "SR2411" (Trademark), made by Dow Corning Toray Silicone Co., Ltd. | 100 |
| Toluene | 300 |

The above prepared coating liquid was coated on an SUS thin plate by spray coating and cured at 100° C. for one hour. Thus, a developer-thin-layer-regulating member (a) was prepared. The volume resistivity of the surface portion of the obtained developer-thin-layer-regulating member (a) was $2.5\times10^{13}$ Ω·cm.

[Developer-thin-layer-regulating member (b)]

The following components were mixed to prepare a coating liquid:

| | Parts by Weight |
|---|---|
| Silicone resin "SR2411" (Trademark), made by Dow Corning Toray Silicone Co., Ltd. | 100 |
| Carbon black "BP-L" (Trademark), made by Cabot Corporation | 5 |
| Toluene | 300 |

The above prepared coating liquid was coated on an SUS thin plate by spray coating and cured at 100° C. for one hour. Thus, a developer-thin-layer-regulating member (b) was prepared. The volume resistivity of the surface portion of the obtained developer-thin-layer-regulating member (b) was $2.1\times10^{8}$ Ω·cm.

The previously prepared matrix toner particles 1 and 2, the fluidity-imparting agents A and B, the developer-bearing members (I) and (II), and the developer-thin-layer-regulating members (a) and (b) were arranged in the following triboelectric series:

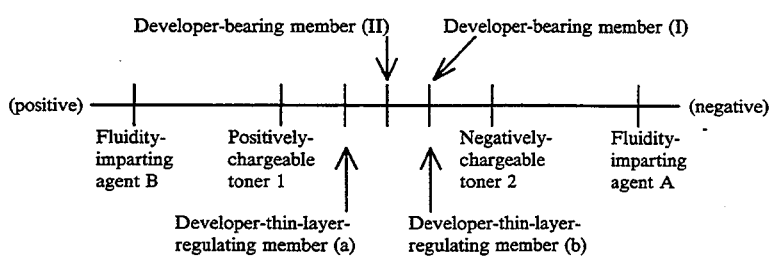

The development apparatus as shown in FIG. 1 was operated, with provided with any of the previously obtained toners, any of the developer-bearing members and the developer-thin-layer-regulating member (a) in combination as shown in Table 6, and the charge quantity of the toner and the toner deposition amount were measured by the same methods as in Example 1. The results are also given in Table 6.

TABLE 6

| | Developer-bearing Member | Developer-thin-layer-regulating Member | Toner | Charge Quantity of Toner (μC/g) | Toner Deposition Amount (mg/cm²) |
|---|---|---|---|---|---|
| Ex. 9 | I | (a) | B | −7.5 | 1.08 |
| Ex. 10 | I | (a) | C | +7.9 | 1.24 |
| Comp. Ex. 9 | I | (a) | A | −2.1 | 0.41 |
| Comp. Ex. 10 | I | (a) | D | +1.5 | 0.50 |
| Ex. 11 | II | (a) | B | −8.9 | 1.20 |
| Ex. 12 | II | (a) | C | +9.3 | 1.31 |
| Comp. Ex. 11 | II | (a) | A | −1.5 | 0.42 |
| Comp. Ex. 12 | II | (a) | D | +1.2 | 0.53 |

Examples 13 and 14

Figure 2:
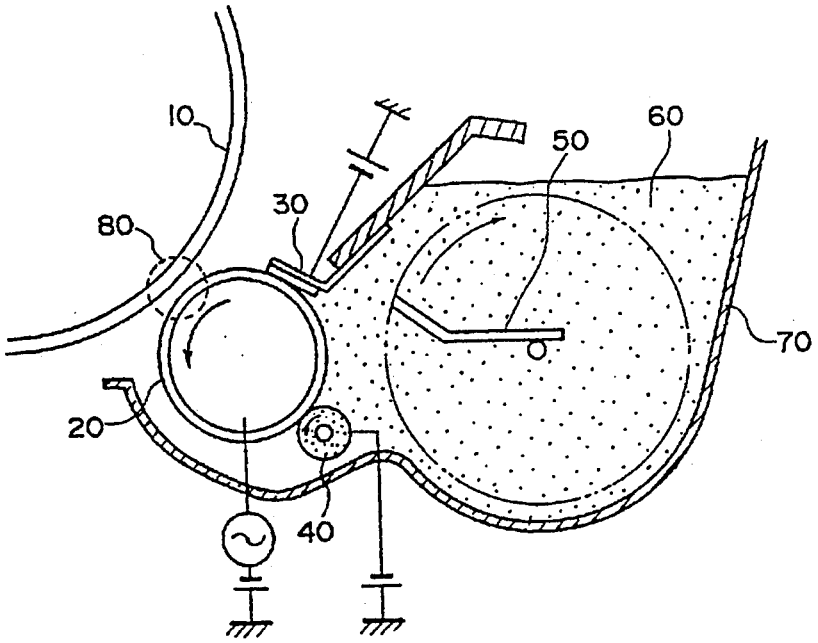
FIG. 2 is a schematic cross-sectional view of another embodiment of a development apparatus according to the present invention.

The development apparatus as shown in FIG. 2 was operated, provided with the previously obtained toner B or C, the developer-bearing member (I) and the developer-thin-layer-regulating member (b) in combination as shown in Table 7, and the charge quantity of the toner and the toner deposition amount were measured by the same methods as in Example 1. The results are also given in Table 7.

As indicated in FIG. 2, a bias was applied in such a fashion that an electrical field was applied from the developer-bearing member to the developer-thin-layer-regulating member in Example 13, and that an electrical field was applied from the developer-thin-layer-regulating member to the developer-bearing member in Example 14.

TABLE 7

| | Developer-bearing Member | Developer-thin-layer-regulating Member | Toner | Charge Quantity of Toner (μC/g) | Toner Deposition Amount (mg/cm²) |
|---|---|---|---|---|---|
| Ex. 13 | I | (b) | B | −13.3 | 1.25 |
| Ex. 14 | I | (b) | C | +14.2 | 1.36 |

As can be seen from the results in Table 7, sufficient charge quantity of toner and toner deposition amount can be obtained when both of the surface portion of the developer-bearing member and the surface portion of the developer-thin-layer-regulating member are intermediate between the matrix toner particles and the fluidity-imparting agent in the triboelectric series thereof.

In addition, when a bias is applied so as to apply the electrical field from the developer-bearing member to the developer-thin-layer-regulating member in the case where the negatively-chargeable toner is used, and a bias is applied to the contrary in the case where the positively-chargeable toner is used, further increased charge quantity of toner and toner deposition amount can be obtained.

In the development apparatus according to the present invention, a non-magnetic one-component developer comprising matrix toner particles and a fluidity-imparting agent is supplied to the surface of the developer-bearing member by the aid of the developer-supplying member and formed into a thin layer on the developer-bearing member by means of the developer-thin-layer-regulating member, and then latent electrostatic images formed on a latent-electrostatic-image-bearing member are developed to visible toner images by the application thereto of the above-mentioned non-magnetic one-component developer. In the present invention, the surface portion of the developer-bearing member is intermediate between the matrix toner particles and the fluidity-imparting agent in the triboelectric series thereof, so that sufficient charge quantity of toner and toner deposition amount can be obtained.

What is claimed is:

1. A development apparatus comprising a developer-bearing-member for developing latent electrostatic images formed on a latent-electrostatic-image-bearing member to visible toner images by the application thereto of a non-magnetic one-component developer comprising matrix toner particles and a fluidity-imparting agent; and a developer-thin-layer-regulating member for forming a thin layer of said non-magnetic one-component developer on the surface of said developer-bearing member, said developer-bearing member having a surface portion which is intermediate between said matrix toner particles and said fluidity-imparting agent in the triboelectric series thereof.

2. The development apparatus as claimed in claim 1, wherein said surface portion of said developer-bearing member is electroconductive.

3. The development apparatus as claimed in claim 2, wherein said surface portion of said developer-bearing member has a volume resistivity of less than $10^{12}$ Ω·cm.

4. The development apparatus as claimed in claim 1, wherein said surface portion of said developer-bearing member is electrically insulating.

5. The development apparatus as claimed in claim 4, wherein said surface portion of said developer-bearing member has a volume resistivity of $10^{12}$ Ω·cm or more and a thickness of 10 μm or less.

6. The development apparatus as claimed in claim 4, wherein said surface portion of said developer-bearing member has a volume resistivity of $10^{12}$ Ω·cm or more and a specific inductive capacity of 20 or more.

7. The development apparatus as claimed in claim 1, wherein said developer-thin-layer-regulating member has a surface portion which is intermediate between said matrix toner particles and said fluidity-imparting agent in the triboelectric series thereof.

8. The development apparatus as claimed in claim 1, for developing latent electrostatic images formed on a latent-electrostatic-image-bearing member having a rotational speed, wherein said developer-bearing member comprises a development roller having a rotational speed substantially equal to that of said latent-electrostatic-image-bearing member.

* * * * *